US007287656B2

(12) United States Patent
Guilford, III et al.

(10) Patent No.: US 7,287,656 B2
(45) Date of Patent: Oct. 30, 2007

(54) CONTAINER FOR PROMOTING THERMAL TRANSFER

(75) Inventors: Robert J. Guilford, III, El Segundo, CA (US); Peter Ethan Staples, Hermosa Beach, CA (US)

(73) Assignee: Blue Clover Design, LLC, Los Angeles, CA (US)

( * ) Notice: Subject to any disclaimer, the term of this patent is extended or adjusted under 35 U.S.C. 154(b) by 483 days.

(21) Appl. No.: 10/817,088

(22) Filed: Apr. 2, 2004

(65) Prior Publication Data

US 2005/0218102 A1 Oct. 6, 2005

(51) Int. Cl.
*A61J 9/00* (2006.01)
*B65D 1/04* (2006.01)
*B65D 25/54* (2006.01)

(52) U.S. Cl. ..... 215/11.1; 215/6; 215/11.6; 215/12.1; 220/504; 220/524; 220/592.17

(58) Field of Classification Search ..... 215/6, 215/11.1, 10, 11.3, 11.6, 12.1, 365; 220/504, 220/524, 592.16, 592.17
See application file for complete search history.

(56) References Cited

U.S. PATENT DOCUMENTS

| | | | | | |
|---|---|---|---|---|---|
| 59,687 | A | * | 11/1866 | Waldstein et al. | 215/6 |
| 514,575 | A | * | 2/1894 | Turner | 215/6 |
| 1,598,085 | A | * | 8/1926 | Kirschmann | 215/6 |
| 3,402,763 | A | | 9/1968 | Peterson | |
| 3,658,122 | A | | 4/1972 | Kalyk | |
| 3,853,236 | A | * | 12/1974 | Ostrowsky | 215/220 |
| 4,163,471 | A | | 8/1979 | Leder | |
| 4,597,435 | A | | 7/1986 | Fosco, Jr. | |
| 4,782,670 | A | | 11/1988 | Long et al. | |
| 5,050,598 | A | * | 9/1991 | Tucker | 607/111 |
| 5,275,298 | A | | 1/1994 | Holley, Jr. | |
| 5,467,877 | A | * | 11/1995 | Smith | 215/11.1 |
| 5,487,486 | A | * | 1/1996 | Meneo | 220/504 |
| 5,597,087 | A | | 1/1997 | Vinarsky | |
| 5,653,343 | A | | 8/1997 | Imai | |
| 5,810,196 | A | | 9/1998 | Lundy | |
| 5,855,315 | A | | 1/1999 | Roseth | |
| 5,975,337 | A | | 11/1999 | Hadley | |
| 5,979,164 | A | | 11/1999 | Scudder et al. | |
| 6,003,698 | A | * | 12/1999 | Morano | 215/11.1 |
| 6,032,810 | A | * | 3/2000 | Meyers et al. | 215/11.1 |

(Continued)

OTHER PUBLICATIONS

Webpage: NHY Controller Co, LTD—Life Sense Technic—Jan. 24, 2004—http://www.nhy.com.tw/eng_page_2.htm.

*Primary Examiner*—Sue A. Weaver
(74) *Attorney, Agent, or Firm*—Jeffrey Schox

(57) ABSTRACT

The container 10 of the preferred embodiment comprises an outer shell 12 and an inner membrane 14 which cooperatively define a first compartment 16 and a second compartment 18. The first compartment 16 defines a first opening 20, through which the first compartment 16 receives a consumable liquid. The second compartment 18 defines a second opening 22, through which the second compartment 18 receives a second liquid. The first compartment 16 and the second compartment 18 are shaped and arranged such that greater than 50% of the surface area of the second compartment 18 is located adjacent to the first compartment 16. Alternatively, the first compartment 16 and the second compartment 18 may be shaped and arranged such that the first compartment 16 substantially surrounds at least a portion of the second compartment 18.

23 Claims, 5 Drawing Sheets

U.S. PATENT DOCUMENTS 6,092,680 A 7/2000 Pillado
6,116,439 A 9/2000 Yaniv
6,123,065 A * 9/2000 Teglbjarg ..... 126/263.09
6,138,848 A 10/2000 Fermo
6,161,720 A 12/2000 Castle
6,234,165 B1 5/2001 Creighton et al.
6,412,527 B1 7/2002 Brice
6,415,624 B1 * 7/2002 Connors et al. ..... 62/457.3
6,417,498 B1 7/2002 Shields et al.
6,427,863 B1 8/2002 Nichols
6,494,056 B1 12/2002 Roth
6,502,418 B2 1/2003 Holley, Jr.
6,571,564 B2 6/2003 Upadhye et al.
6,598,418 B2 7/2003 Holley, Jr.
D478,511 S * 8/2003 Reynolds ..... D9/502
6,609,637 B1 * 8/2003 Suffa ..... 222/545
6,722,513 B1 * 4/2004 Flood et al. ..... 215/11.1
6,745,505 B2 * 6/2004 Moran ..... 40/311

* cited by examiner

CONTAINER FOR PROMOTING THERMAL TRANSFER

TECHNICAL FIELD

This invention relates generally to the container field, and more specifically to an improved container that promotes thermal transfer between a consumable liquid and a second liquid.

BACKGROUND

Bottles and other containers are often used to store consumable liquids that require heating or cooling prior to consumption. Often times, especially when traveling, it can be difficult to find an adequate means to heat or cool such a liquid. Presently, some inventions exist to address this problem, but few provide a simple solution. Thus it is desired to provide a means for heating or cooling a consumable liquid that utilizes a second liquid, which is easily obtained. This invention provides such a solution.

DESCRIPTION OF THE PREFERRED EMBODIMENT

The following description of the preferred embodiment of the invention is not intended to limit the invention to this preferred embodiment, but rather to enable any person skilled in the art to make and use this invention.

Figure 1:
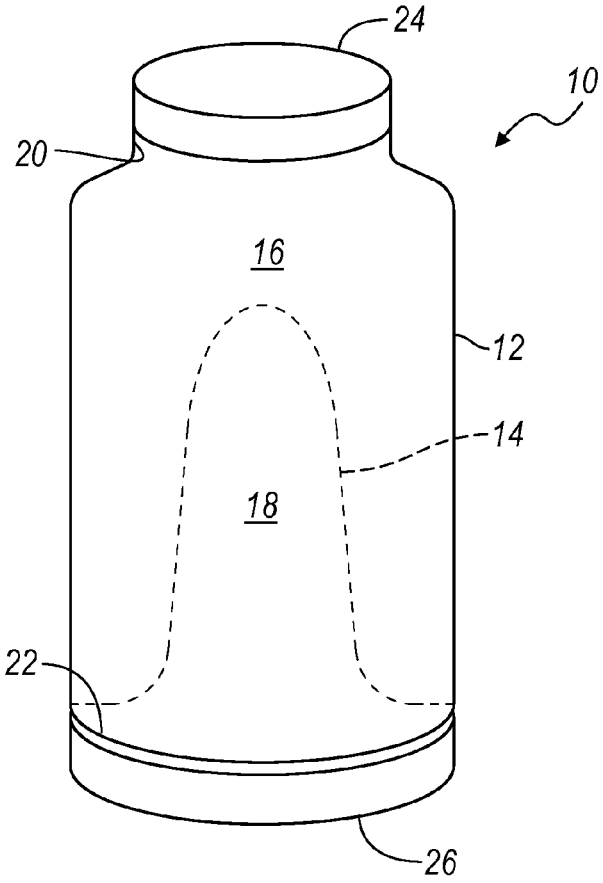
FIG. 1 is a perspective view of the preferred embodiment of the invention.
Figure 2:
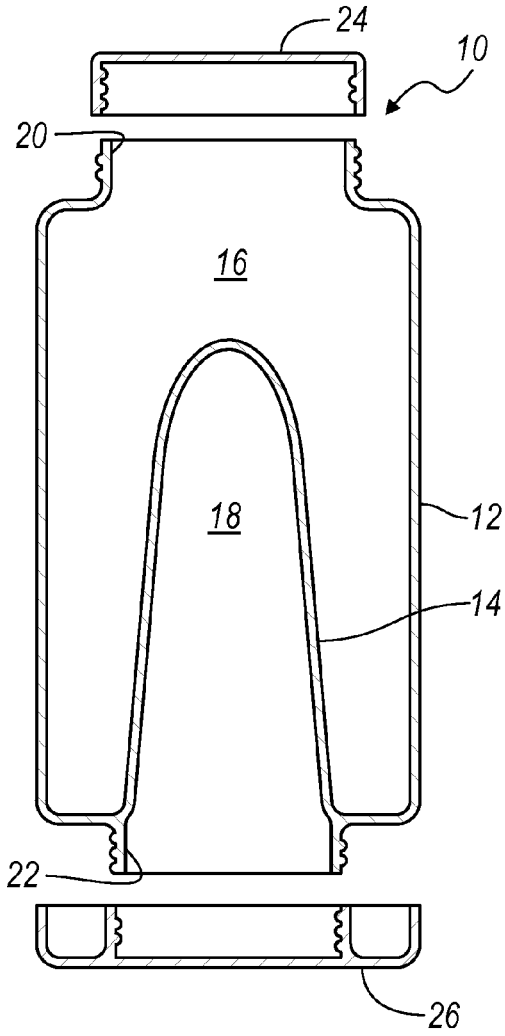
FIG. 2 is a cross-sectional view of the preferred embodiment of the invention.

As shown in FIGS. 1 and 2, the container 10 of the preferred embodiment comprises an outer shell 12 and an inner membrane 14 which cooperatively define a first compartment 16 and a second compartment 18. The first compartment 16 defines a first opening 20, through which the first compartment 16 receives a consumable liquid. The second compartment 18 defines a second opening 22, through which the second compartment 18 receives a heating liquid. The first compartment 16 and the second compartment 18 are shaped and arranged such that greater than 50% of the surface area of the second compartment 18 is located adjacent to the first compartment 16. Alternatively, the first compartment 16 and the second compartment 18 may be shaped and arranged such that the first compartment 16 substantially surrounds at least a portion of the second compartment 18.

The primary function of the container 10 allows the user to heat a consumable liquid with a heating liquid. Alternatively, the consumable liquid can be cooled with a cooling liquid. The consumable liquid may be milk or alternatively soup, coffee, or any other suitable liquid. The heating liquid is preferably water, but may alternatively be another liquid. The consumable liquid and second liquid are preferably held in separate compartments of the container such that the two liquids do not mix, but heat is transferred between them. By having a substantial portion of the surface area of the second compartment 18 be adjacent to the first compartment 16, the majority of the heat from the heating liquid will be transferred to the consumable liquid as opposed to being lost to the surrounding environment. Preferably, the first compartment 16 and the second compartment 18 are shaped and arranged such that greater than 50% of the surface area of the second compartment 18 is located adjacent to the first compartment 16. More thermal efficiency, however, is realized if the first compartment 16 and the second compartment 18 are shaped and arranged such that greater than 75% of the surface area of the second compartment 18 is located adjacent to the first compartment 16. Even more thermal efficiency is realized if the first compartment 16 and the second compartment 18 are shaped and arranged such that about 90% of the surface area of the second compartment 18 is located adjacent to the first compartment 16.

In the preferred embodiment, the container 10 is arranged such that the first opening 20 and the second opening 22 are located on substantially opposite ends of the container 10 and face substantially opposite directions. Alternatively, the first opening 20 and the second opening 22 may be arranged in another manner. Preferably, the outer shell 12 has a substantially cylindrical shape. Alternatively, the outer shell 12 may have a spherical, conical, or other shape. The inner membrane 14 preferably has a substantially conical shape and prevents mixing of the contents of the first compartment 16 and the second compartment 18. The inner membrane 14 may alternatively have a cylindrical, spiral, or other shape which functions to provide a significant portion of the surface area of the second compartment 18 to be located adjacent to the first compartment.

Preferably, the container 10 is preferably composed of hard plastic (such as LEXAN), but may alternatively be formed from another non-porous material. Preferably, the container 10, especially the second compartment 18, can withstand boiling water or temperatures of up to 110 degrees C. without undergoing significant deformation or change in material properties. Alternatively, if the container 10 is designed for cooling liquids, the container 10 may only withstand significantly lower temperatures. The container 10 is preferably manufactured by injection molding the material surrounding the first compartment 16, injection molding the material surrounding the second compartment 18, and then sonic welding the two parts to form one uniform piece. The container 10 may, however, be manufactured by using any suitable method.

The preferred embodiment of the container 10 also comprises a first cap 24 and a second cap 26. The first cap 24 and the second cap 26 are adapted that they may be fastened about the first opening 20 and the second opening 22 respectively.

Figure 3:
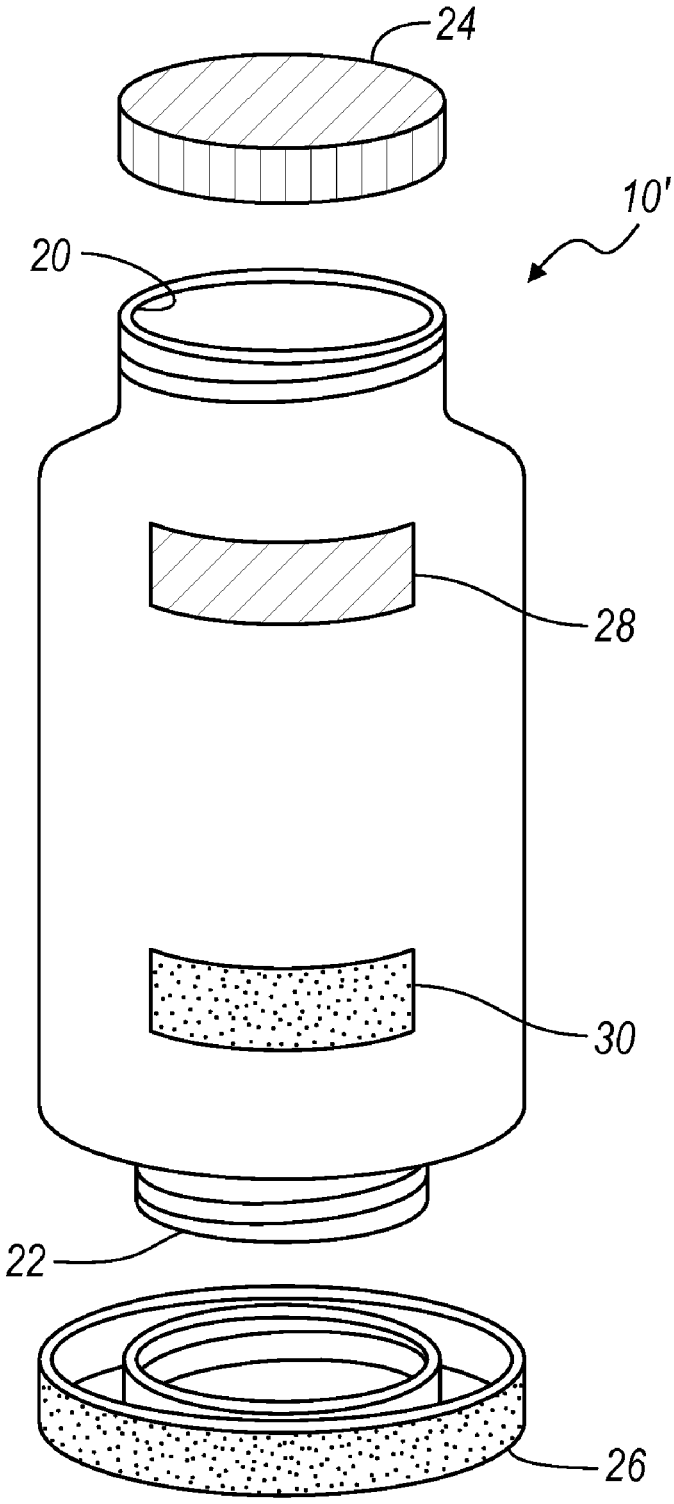
FIG. 3 is a perspective view of an alternative embodiment of the invention.

In the preferred embodiment, the first cap 24 is adapted such that it cannot be fastened about the second opening 22. This adaptation of the first cap 24 provides a safety function helping to prevent the heating liquid from accidentally leaking, spilling, or dispensing from the container 10. The first cap 24 may have a different size or shape than the second cap 26, fasten by a different means (i.e. snapping, threading, etc.), or may incorporate any alternative means which functions to prevent the fastening of the first cap 24 about the second opening 22. In an alternative embodiment, the first cap 24 and the second cap 26 may be used interchangeably. In the alternative embodiment, as shown in FIG. 3, the container 10' may include a first indicator 28 near the first opening 20 and a second indicator 30 near the second opening 22. Further, the first cap 24 and the first indicator 28 are a first color (such as white for milk), while the second cap 26 and the second indicator 30 are a second color (such as red for hot water). Preferably, the second color is noticeably different from the first color to promote the correct disposal of the consumable liquid into the first compartment and the second liquid into the second compartment. The container 10' may, however, include other kinds of indicators to promote the correct disposal of the liquids into the container.

Figure 4A:
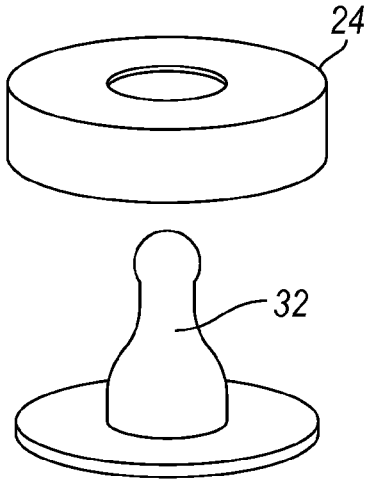
FIGS. 4A, 4B, 4C, and 4D are perspective views of four alternative caps for the preferred embodiment.
Figure 4B:
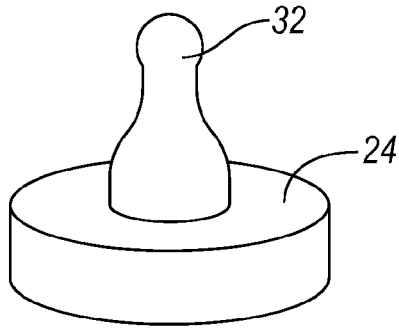
Figure 4C:
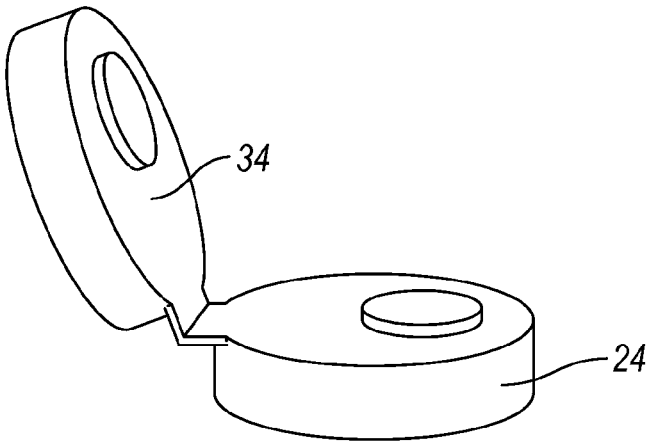
Figure 4D:
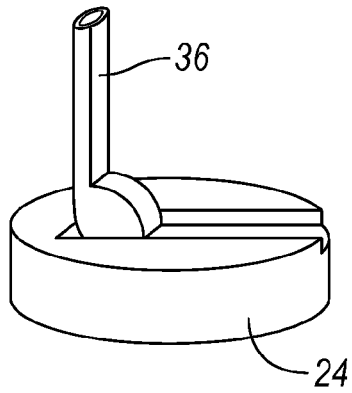

In the preferred embodiment of the container 10, the first cap 24 is adapted to provide a means for dispensing a consumable liquid from the first compartment 16. As shown in FIGS. 4A and 4B, the first cap 24 may include a nipple 32 removably attached (FIG. 4A) or irremovably integrated (FIG. 4B). As shown in FIGS. 4C and 4D, the dispensing means of the first cap 24 may alternatively include a flip top cap 34 (such as found on a ketchup bottle), a spout 36, or any other means which allows the user to easily dispense the contents of the first compartment 16. In an alternative embodiment, the first cap may not provide a dispensing means.

Figure 5:
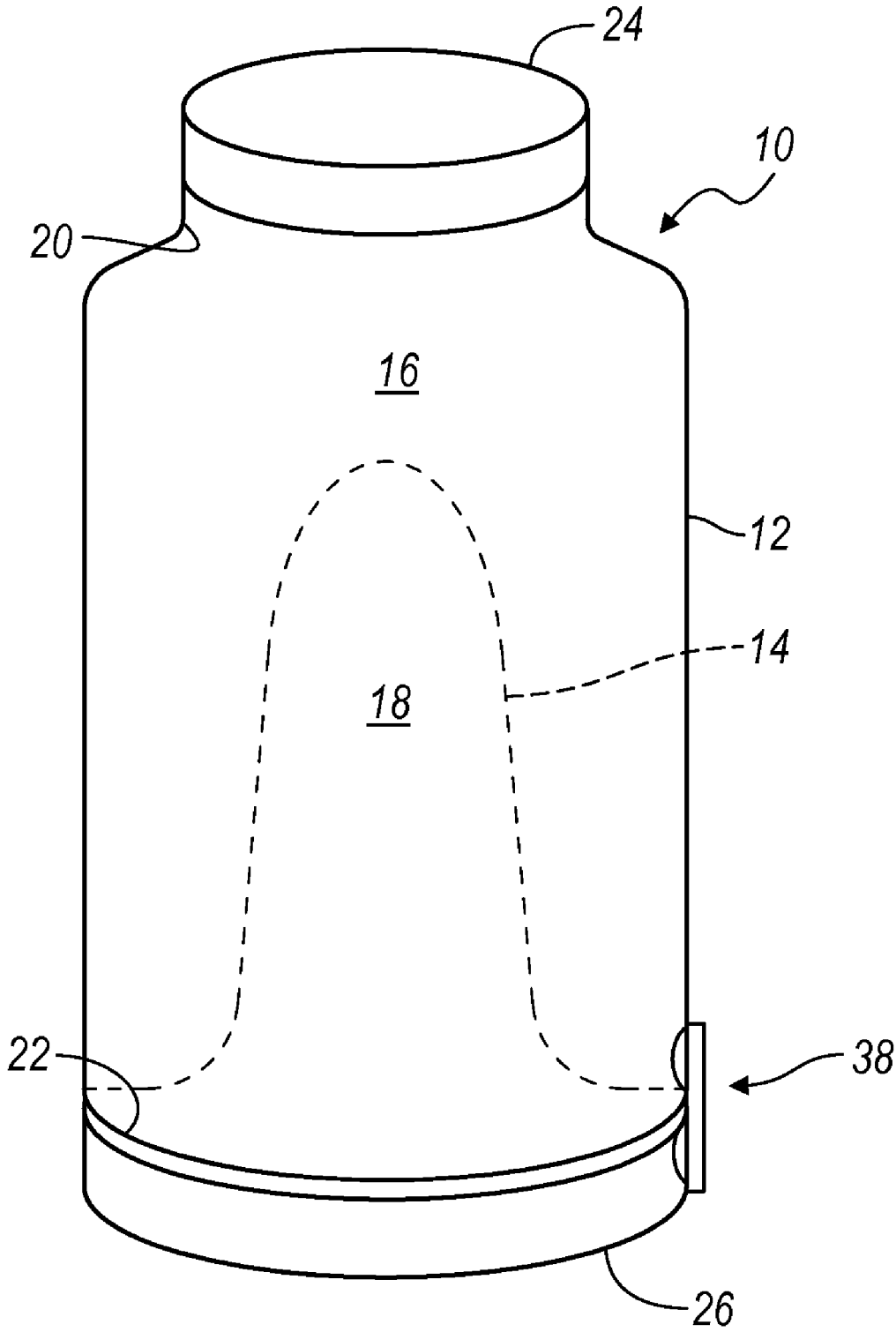
FIG. 5 is a cross-sectional view of the preferred embodiment of the invention, shown with a safety lock.

As shown in FIGS. 1 and 2, in the preferred embodiment of the container 10, the second cap 26 may be adapted to provide a platform for the container 10. The second cap 26 is shaped to provide a flat bottom for the container 10 allowing it to rest in a substantially vertical orientation. The platform may be provided alternatively by another means, such as legs or a hook, which allows the container 10 to rest in a substantially stable position. Alternatively, the second cap 26 may not provide a platform. The second cap 26 of the preferred embodiment is adapted to include a locking means 38, as shown in FIG. 5, to prevent accidental removal of the second cap 26. The locking means 38 prevents spilling of the heating liquid from the container. This locking means 38 may be similar to the snapping or threading means found on medicine bottles or any alternative means which functions to prevent the accidental removal of the second cap 26. Alternatively, the second cap 26 may not include a locking means.

Figure 6A:
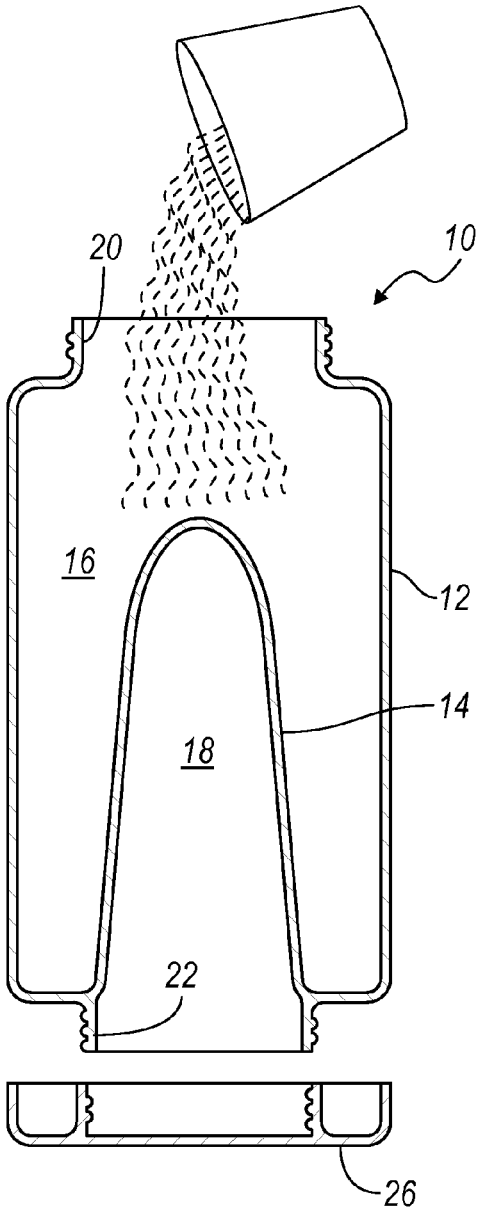
FIGS. 6A and 6B are cross-sectional views of the preferred method of the invention.
Figure 6B:
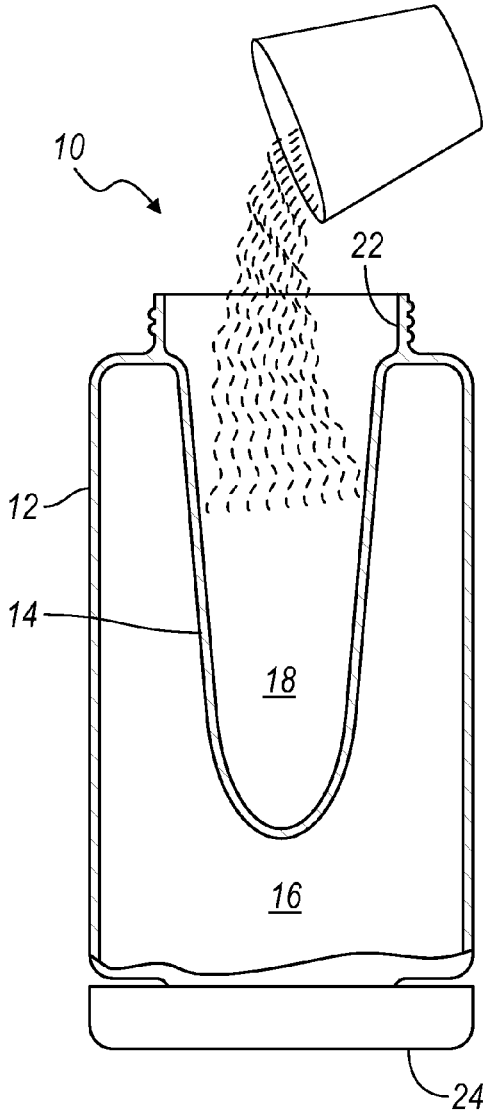

The first preferred use of the container 10 includes the steps of: 1) disposing a consumable liquid into the first compartment 16, as shown in FIG. 6A, 2) disposing a heating liquid into the second compartment 18, as shown in FIG. 6B, and 3) allowing heat to transfer from the heating liquid to the consumable liquid. The second preferred use of the container 10 includes the steps of: 1) disposing a consumable liquid into the first compartment 16, as shown in FIG. 6A, 2) disposing a cooling liquid into the second compartment 18, as shown in FIG. 6B, and 3) allowing heat to transfer from the consumable liquid to the cooling liquid. Alternatively, the container 10 may be used as storage container for the consumable liquid.

As a person skilled in the art will recognize from the previous detailed description and from the figures and claims, modifications and changes can be made to the preferred embodiment of the invention without departing from the scope of this invention defined in the following claims.

We claim:

1. A container for promoting thermal transfer between a consumable liquid and a second liquid comprising:

an outer shell;

an inner membrane integrally attached to the outer shell, wherein the outer shell and the inner membrane cooperatively define a first compartment and a second compartment such that at least 50% of the surface area of the second compartment is located adjacent to the first compartment;

wherein the first compartment defines a first opening adapted to receive the consumable liquid and the second compartment defines a second opening adapted to receive the second liquid;

a first cap adapted to be fastened about the first opening and a second cap adapted to be fastened about the second opening; and wherein the outer shell includes a first indicator near the first opening and a second indicator near the second opening, wherein the first cap and the first indicator are a first color, and wherein the second cap and the second indicator are a second color that is noticeably different than the first color.

2. The container of claim 1 wherein the first cap is further adapted to not fasten about the second opening.

3. The container of claim 1 wherein the first cap is further adapted to receive a nipple.

4. The container of claim 1 wherein the first cap includes a nipple.

5. The container of claim 1 wherein the second cap is shaped to provide a platform for the container.

6. The container of claim 1 wherein the inner membrane prevents mixing of the consumable liquid in the first compartment and the heating liquid in the second compartment.

7. The container of claim 1 wherein the first opening and the second opening are located at substantially opposite ends of the container.

8. The container of claim 7 wherein the inner membrane has a substantially conical shape.

9. The container of claim 8 wherein the outer shell has a substantially cylindrical shape.

10. The container of claim 1 wherein the first cap and the first indicator are white.

11. The container of claim 1 wherein the second cap and the second indicator are red.

12. A container for promoting thermal transfer between a consumable liquid and a second liquid:

an outer shell;

an inner membrane integrally attached to the outer shell, wherein the outer shell and the inner membrane cooperatively define a first compartment and a second compartment such that the first compartment substantially surrounds at least a portion of the second compartment;

wherein the first compartment defines a first opening adapted to receive the consumable liquid and the second compartment defines a second opening adapted to receive the second liquid;

a first cap adapted to be fastened about the first opening and a second cap adapted to be fastened about the second opening; and wherein the outer shell includes a first indicator near the first opening and a second indicator near the second opening, wherein the first cap and the first indicator are a first color, and wherein the second cap and the second indicator are a second color that is noticeably different than the first color.

13. The container of claim 12 wherein the first cap is further adapted to not fasten about the second opening.

14. The container of claim 12 wherein the first cap is further adapted to receive a nipple.

15. The container of claim 12 wherein the first cap includes a nipple.

16. The container of claim 12 wherein the second cap is shaped to provide a platform for the container.

17. The container of claim 12 wherein the second cap is further adapted to include a safety lock.

18. The container of claim 12 wherein the inner membrane prevents mixing of the consumable liquid in the first compartment and the heating liquid in the second compartment.

19. The container of claim 12 wherein the first opening and the second opening are located at substantially opposite ends of the container.

20. The container of claim 19 wherein the inner membrane has a substantially conical shape.

21. The container of claim 20 wherein the outer shell has a substantially cylindrical shape.

22. The container of claim 12 wherein the first cap and the first indicator are white.

23. The container of claim 12 wherein the second indicator are red.

* * * * *

UNITED STATES PATENT AND TRADEMARK OFFICE

CERTIFICATE OF CORRECTION

PATENT NO. : 7,287,656 B2
APPLICATION NO. : 10/817088
DATED : October 30, 2007
INVENTOR(S) : Peter Ethan Staples It is certified that error appears in the above-identified patent and that said Letters Patent is hereby corrected as shown below:

In column 4, line 41, "consumable liquid and a second liquid:" should read --consumable liquid and a second liquid comprising:--

In column 6, lines 8 and 9, "wherein the second indicator" should read --wherein the second cap and second indicator--

Signed and Sealed this

Fifteenth Day of July, 2008

JON W. DUDAS
*Director of the United States Patent and Trademark Office*